United States Patent [19]

Stuckey et al.

[11] 3,999,260

[45] Dec. 28, 1976

[54] ROTARY POWER SLIP ASSEMBLY

[75] Inventors: Terry E. Stuckey; Edward J. McFadden, both of Houston, Tex.

[73] Assignee: BJ-Hughes Inc., Houston, Tex.

[22] Filed: Jan. 9, 1976

[21] Appl. No.: 647,760

[52] U.S. Cl. ..... 24/263 DG

[51] Int. Cl.[2] ..... A47B 21/00

[58] Field of Search ... 24/263 DG, 263 DA, 263 DQ, 24/263 DS, 263 CA, 263 KH, 263 DM, 263 KC

[56] References Cited

UNITED STATES PATENTS

| | | | |
|---|---|---|---|
| 1,661,285 | 3/1928 | Greve | 24/263 DQ |
| 2,545,627 | 3/1951 | Moore | 24/263 DG |
| 2,564,119 | 8/1951 | Mathews et al. | 24/263 DG X |
| 2,730,331 | 1/1956 | Harinck | 24/263 DG X |
| 2,814,461 | 11/1957 | Martin | 24/263 DG |
| 2,939,683 | 6/1960 | Spiri | 24/263 DG |
| 3,149,391 | 9/1964 | Boster | 24/263 CA |
| 3,571,865 | 3/1971 | Johnson | 24/263 DG |

*Primary Examiner*—Paul R. Gilliam
*Assistant Examiner*—V. N. Sakran

[57] ABSTRACT

A pneumatically operated rotary power slip assembly which is mountable in a rotary drilling table. It includes a stationary housing having an annular opening therethrough adapted for mounting generally coaxially with the pipe opening in the rotary table. The stationary housing has a conduit therein for transmitting pressurized fluid. The assembly includes a rotary housing having an annular opening therethrough, which housing is adapted for mounting generally coaxially with the opening in the rotary table and for rotation therewith. The stationary housing is provided with a pair of inflatable annular seals which, together with the rotary housing, form two axially spaced apart annular ducts between said housings upon inflation of the seals. The rotary housing supports at least one generally radially extendable and retractable slip, which slip is arranged to engage a pipe inserted through the rotary housing in the radially inwardly extended position and for releasing the pipe in the radially outwardly retracted position. At least one pneumatic cylinder is mounted in the rotary housing and arranged for moving the slips radially inwardly and outwardly upon actuation thereof. Additional conduits are provided in the rotary housing for communicating with each of the aforesaid ducts and transmitting pressurized fluids to the pneumatic cylinder for operation of the aforesaid slips. The apparatus includes valve means for controlling alternate flow of fluids through the ducts to control operation of the pneumatic cylinder to move the slip radially inwardly and outwardly. There is thus provided a rotary power slip assembly which is removably inserted in a rotary drilling table wherein the pneumatic cylinder rotates with the slips such that the slips can be positioned in any position around the full circumference of the opening through the drilling table. The seal arrangement for transmitting fluid pressure to the pneumatic cylinder permits operation of the cylinder in any position, as aforesaid.

13 Claims, 13 Drawing Figures

FIG. 10
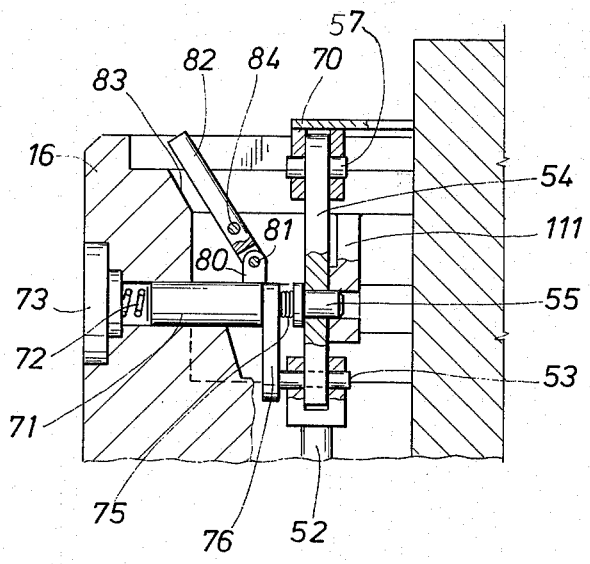
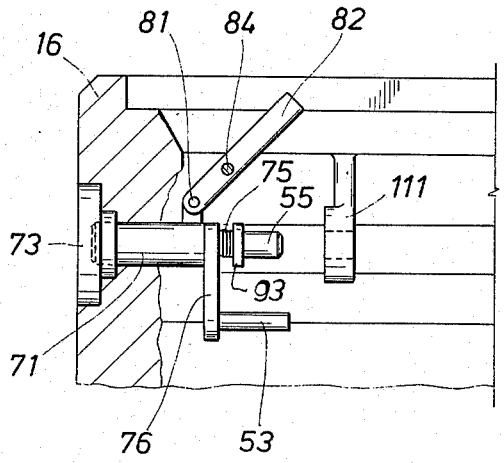
FIG. 11
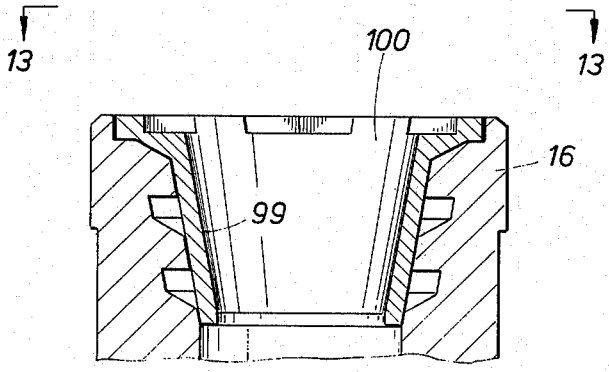
FIG. 12
FIG. 13
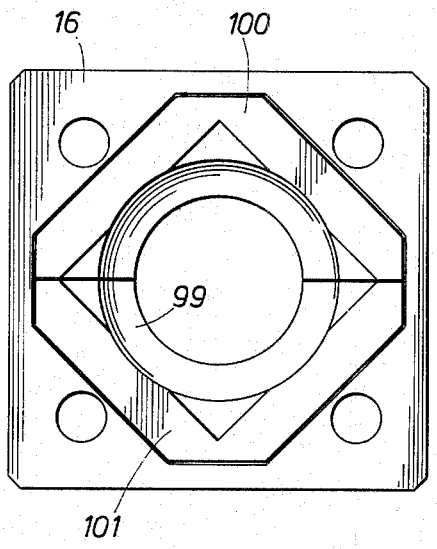

ROTARY POWER SLIP ASSEMBLY

BACKGROUND OF THE INVENTION a. Field of the Invention

This invention relates to a rotary power slip assembly which is removably mountable with a rotary drilling table. It is particularly useful for running drill pipe in and out of a well bore and for running casing pipe into a well bore. The tool of this invention permits the use of the power drive assembly associated with the rotary table to be used in the aforesaid running operations.

b. Description of the Prior Art

One tool has heretofore been offered to the trade which utilizes slips mounted in a rotary housing, but such slips are operated by an air actuated cylinder mounted in a stationary portion of the rotary table. Accordingly, there is a mechanical linkage in the form of a shifting ring. However, tools of the aforesaid type are not fully satisfactory in all instances. For example, the aforesaid shift ring is subject to fouling and malfunctioning. It is also desirable to have a power slip assembly wherein the slips are not exposed above the surface of the drill table to any large extent and wherein the slips are removable so that the master bushing of the rotary drilling table can be converted to API specifications readily. It is also desirable to have a power slip assembly which is readily movable from the drilling table so that other drilling operations may be carried on.

SUMMARY OF THE INVENTION

It is, therefore, an object of this invention to provide an improved rotary power slip assembly, which assembly will achieve the aforesaid desirable objectives in a more efficient and useful manner.

Briefly stated, this invention is for a rotary power slip assembly mountable with a rotary drilling table. It includes the combination of a stationary housing having an annular opening therethrough adapted for mounting generally coaxially with the pipe opening in the rotary table. The stationary housing is provided with the first conduit means for transmitting pressurized fluid. The assembly also includes a rotary housing having an annular opening therethrough, which housing is adapted for mounting generally coaxially with the opening in the rotary table for rotation therewith. Means are provided in the stationary housing which, cooperative with the rotary housing, form at least one annular fluid duct therewith, with the duct being arranged for communication with the aforesaid first conduit means. The tool includes at least one generally radially extendable and retractable slip mounted in the rotary housing for rotation therewith, with the slip being arranged to engage a pipe inserted in the annular pipe opening in the rotary housing in the radially inwardly extended position and for releasing the pipe in the radially outwardly retracted position. Fluid actuated operated means are provided and mounted in the rotary housing for rotation therewith and are arranged for moving the slip to at least one of the said radial positions upon actuation thereof. Second conduit means are provided for interconnecting the annular fluid duct and the operator means for applying fluid pressure from the first conduit means to the operator. Valve means are provided for controlling flow of fluid through the first conduit means, the annular duct and the second conduit means, to thereby operate the operator means and move the slip as aforesaid.

Preferably, the operator means is in the form of a pneumatic piston and cylinder assembly and linkage means are included for interconnecting the piston rod of the piston and cylinder assembly with the slip to actuate the same. In certain embodiments, it is desirable to have means in the stationary housing which are cooperative with the rotary housing for forming another annular fluid duct. In this embodiment, additional conduit means are provided whereby one of the aforesaid ducts is arranged to conduct pressurized fluid to one end of the pneumatic cylinder and the other duct is arranged to apply fluidized pressure to the other end of the cylinder. In this embodiments, valve means are also provided for selectively applying the fluid alternately to the two ducts.

In the preferred form of the invention, the slips are arranged for being received in annular recesses on the internal bore of the rotary housing in the retracted position and for radially inward camming action when moved downwardly in said housing.

Preferably, the slip is removably held in the rotary housing so that the same may be removed therefrom and a bushing insert placed back in the rotary housing to convert the rotary housing to a conventional API master bushing, so that additional drilling operations may be carried out. In one form of the invention, the aforesaid annular fluid ducts are formed by inflatable seal means which are actuatable to the inflated position when the rotary housing is in a static position, thereby completing the conduit for applying pressurized fluid to the pneumatic cylinder as aforesaid.

BRIEF DESCRIPTION OF THE DRAWINGS

Reference to the drawings will further explain the invention wherein:

FIG. 10 is a fragmentary partial sectional view of the unlatching means whereby the slip may be removed from the rotary housing.

FIG. 11 is a view similar to FIG. 10 but showing the latch mechanism actuated and the slip assembly removed.

FIG. 12 is a central sectional view of the rotary housing portion of the invention showing the slip assembly removed and with a bushing insert inserted in the rotary housing to thereby convert the rotary housing to a conventional API master bushing.

FIG. 13 is a top plan view generally taken along line 13—13 in FIG. 12.

DESCRIPTION OF THE PREFERRED EMBODIMENT

Figure 1:
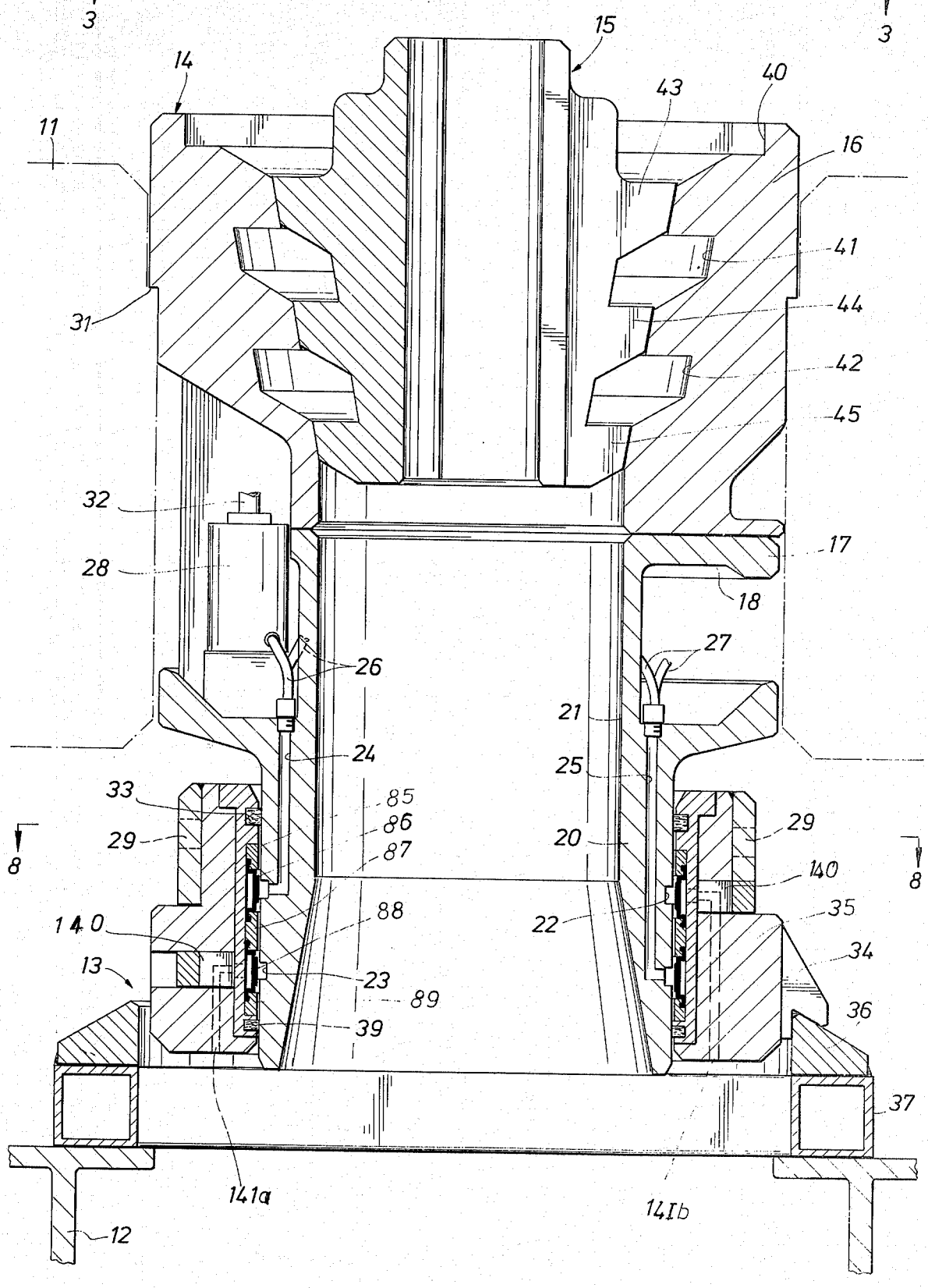
FIG. 1 is a generally central sectional view of one presently preferred embodiment of the invention showing the same mounted in a rotary table on a drilling floor.
Figure 2:
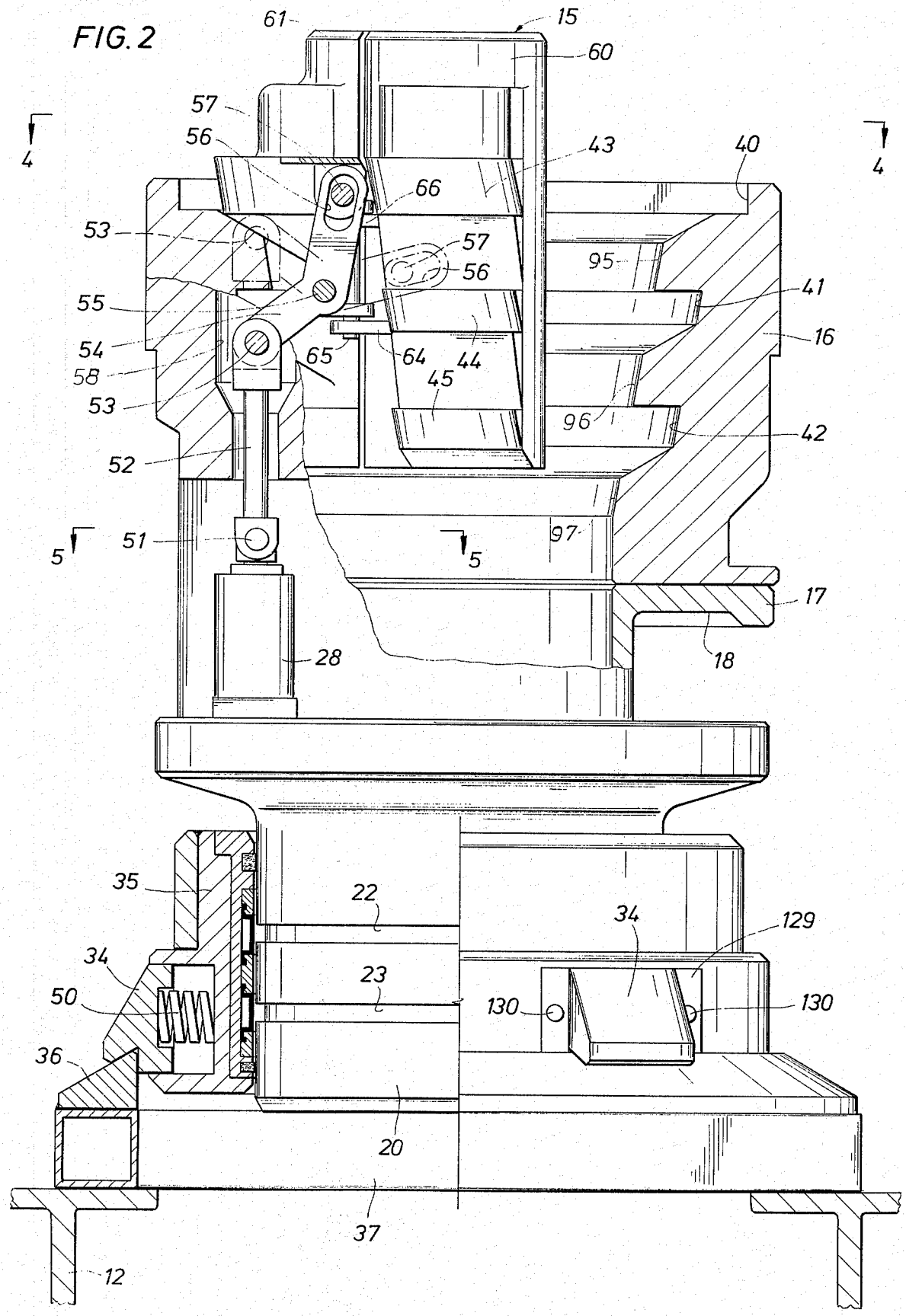
FIG. 2 is a side elevation view only partly in central section of the apparatus shown in FIG. 1 but with the slips shown in the retracted position.
Figure 3:
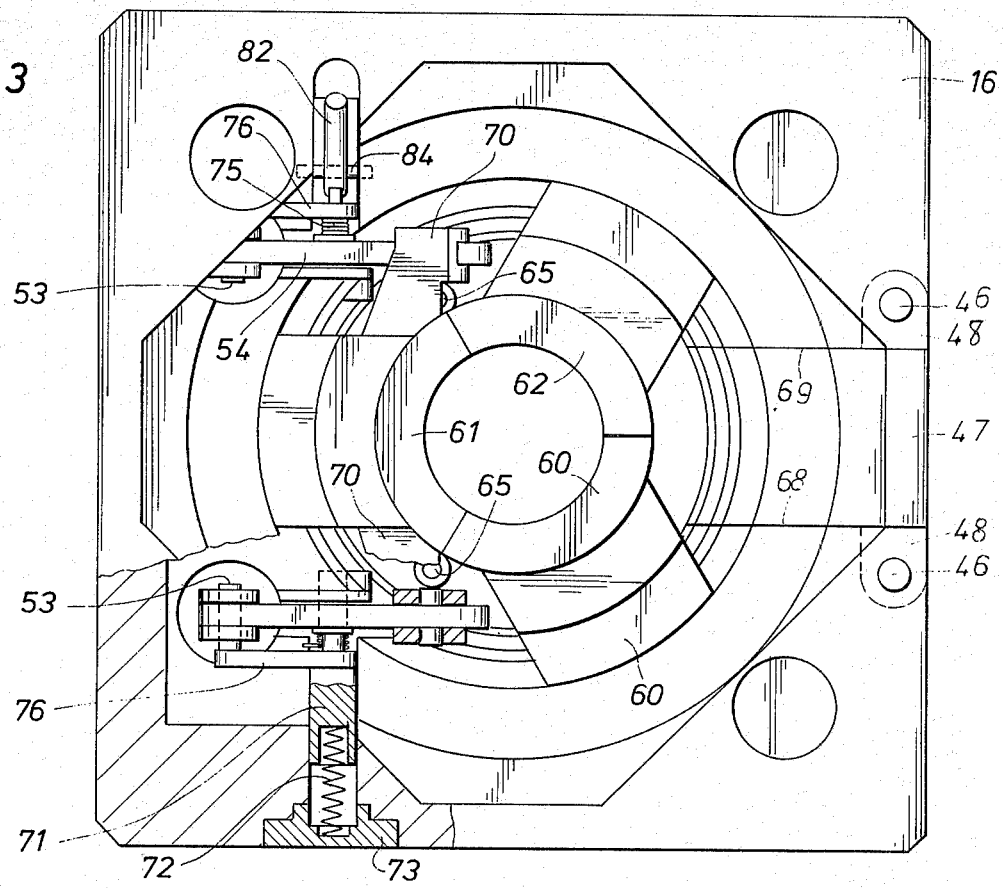
FIG. 3 is generally a top plan view taken generally along line 3—3 of FIG. 1, but showing certain portions broken away for purposes of convenience.
Figure 4:
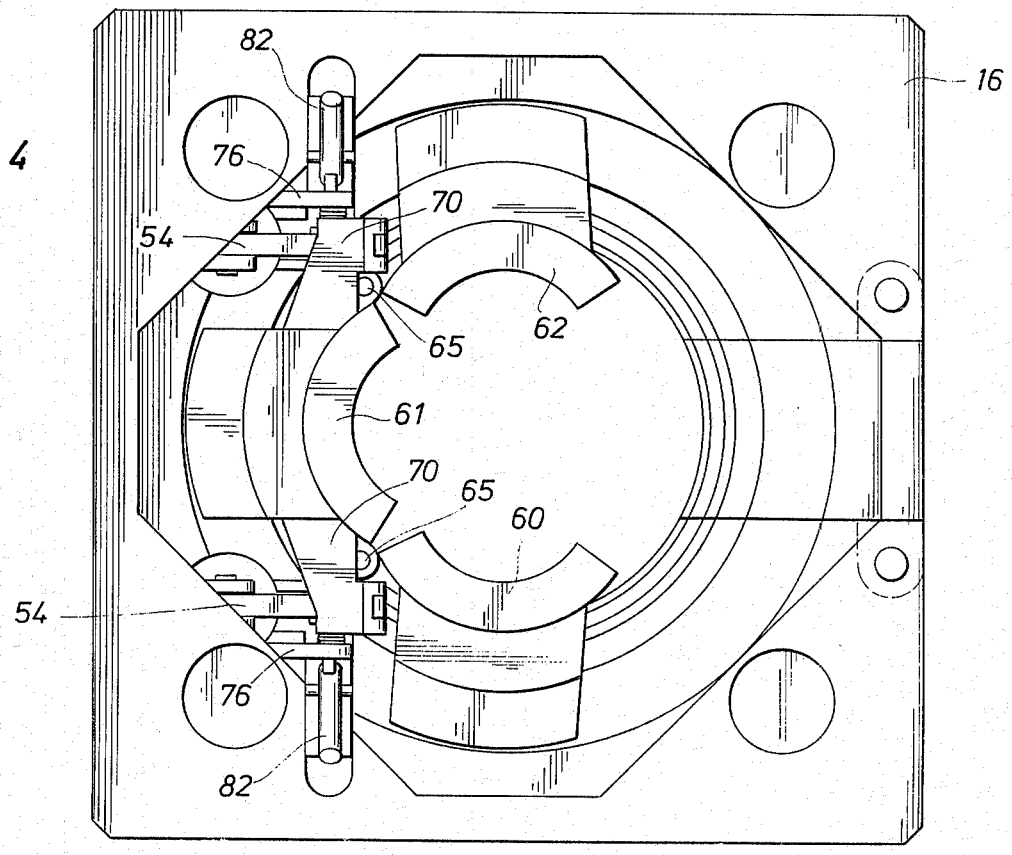
FIG. 4 is a top plan view generally taken along line 4—4 of FIG. 2.

Referring now to FIGS. 1–4 in particular, the rotary housing of this invention is generally designated by the numeral 14, which is provided with an external configuration comparable to a standard master bushing and is arranged for support in rotary table 11 in the same manner. Hence, upon rotation of rotary table 11, rotary housing 14 will be caused to be rotated thereby while being supported therein. Housing 14 is comprised of an upper section 16 which is generally square in plan view as shown in FIGS. 3 and 4 and is provided with a shoulder 31 which engages a complimentary shoulder in the opening in rotary table 11. Section 16 has attached therebelow as by welding or the like a lower section 17 which includes cylinder housing 20, and is arranged for rotation with upper section 16. Cylinder housing 20 is provided with a circumferential recess 18 in which is mounted a pair of vertically extending pneumatic cylinders 28.

The stationary housing of this invention is generally designated by the numeral 13 and includes seal ring assembly 35 having a plurality of spring biased dogs 34 which are arranged to contact and be supported by landing ring 36 which is supported on and attached to a square shaped support member 37 which is arranged for support by substructure 12 of the drilling floor. Dogs 34 are urged radially outwardly by springs 50 and retained in assembly 35 by cover plates 129 secured to ring assembly 35 by bolts 130. Hence, when dogs 34 are depressed radially inwardly, seal ring 35 may be passed down through the opening in rotary table 11 and landed upon landing ring 36 in the manner shown in FIGS. 1 and 2. In order to facilitate the lowering of seal ring assembly 35 to the position shown, the external surface thereof is provided with a pair of J-slots 29 in which a conventional lowering tool may be engaged.

The internal surface of seal ring assembly 35 is provided with a pair of axially spaced apart recesses in which are mounted wiper seals 33 and 39 which are arranged to provide a wiping seal with the external surface of cylindrical housing 20 as shown, to thereby maintain the area therebetween free of foreign substances. The internal surface of ring assembly 35 is also provided with an annular recess in which is received a pair of elastomeric diaphragm seals designated by the numerals 86 and 88. The upper edge of seal 86 is secured by an overlapping split retainer ring 85 which is bolted or otherwise secured to ring assembly 35 so as to seal off the upper edge of seal 86. Similarly, the lower edge of seal 88 is secured by split retainer ring 89, which is similar to ring 85, and is bolted or otherwise secured to ring assembly 35 so as to seal the lower edge of diaphragm seals 88. In addition, retainer ring 87 is mounted between seals 88 and 86 and overlays the proximate edges thereof so as to complete the sealing of seals 86 and 88 with ring. assembly 35. Retainer ring 87 is held in this position by bolts or otherwise, as may be convenient.

Figure 8:
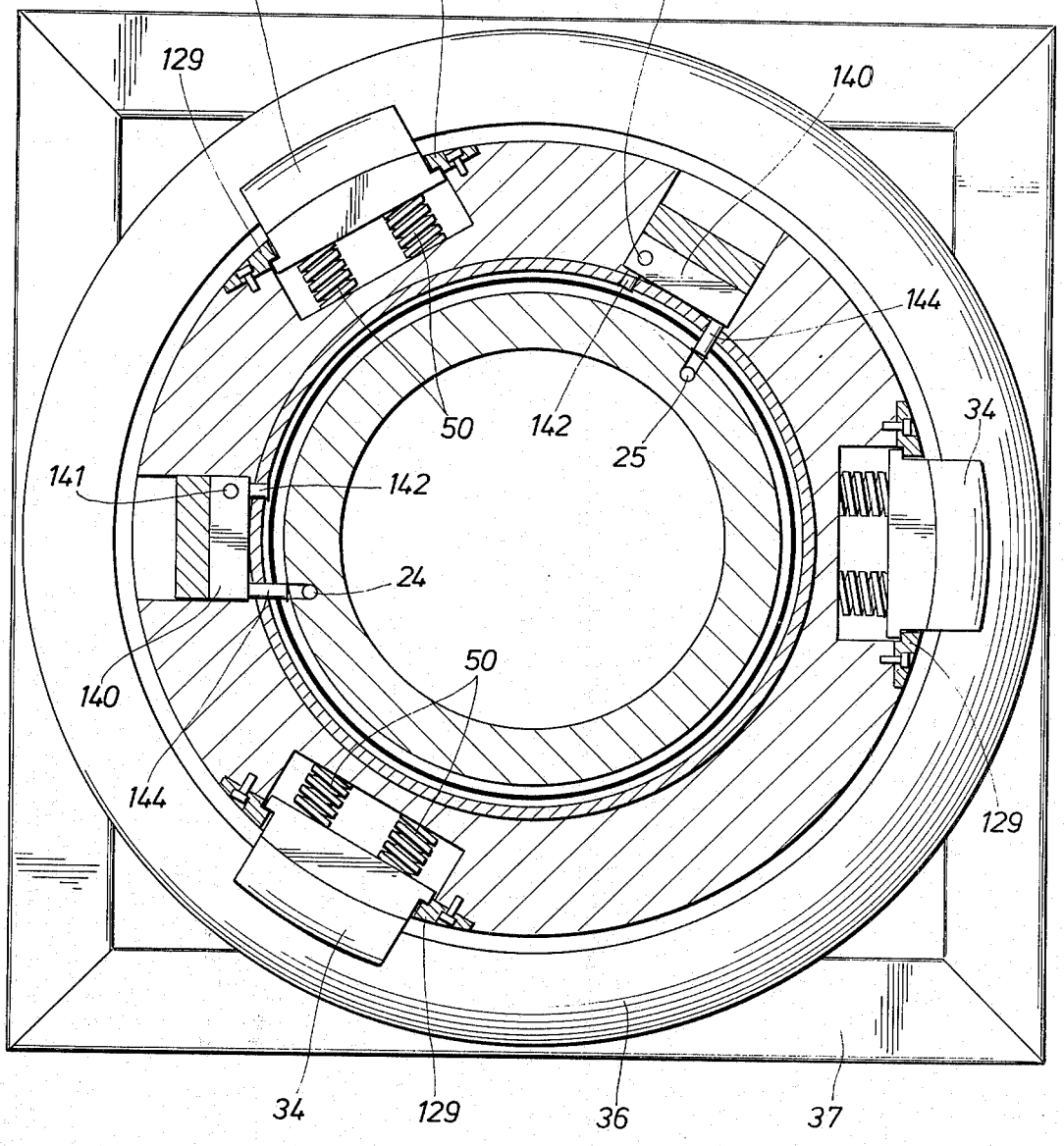
FIG. 8 is a sectional view taken generally along line 8—8 of FIG. 1, but showing one of the check valves rotated 120° from the other check valve 1, rather than 180° as is shown for convenience only in FIG. 1.

Seal ring 35 also supports two check valves, each of which is designated by the numeral 140 and in FIG. 1 are shown positioned at 180° from each other. In fact, however, they are spaced 120° as shown in FIG. 8. Details of check valves 140 will be explained hereinafter by reference to FIGS. 8 and 9, except to say that check valves 140 are arranged to supply fluid pressure to expand seals 86 and 88 radially inwardly to thereby cover the annular recesses 22 and 23 provided in the external surface of cylinder housing 20, when such housing is in a static condition. Further, check valves 140 are arranged for communication with air inlet ports 141*a* and 141*b* provided in ring assembly 35 as shown in FIG. 1 to which inlet ports coupling is made to a convenient source of fluid pressure, such as air pressure.

Annular recess 22 provided about cylinder housing 20 is arranged for communication with air conduit 24 which in turn is shown connected to air line 26 which is arranged to deliver pressurized fluid to the lower ends of pneumatic cylinders 28, to thereby cause extension therefrom of piston rods 32. For purposes of convenience, pneumatic cylinders 28 and certain elements associated therewith may sometimes be referred to as operator means. Annular recess 23 about cylinder housing 20 is arranged for communication with air conduit 25 which in turn is connected with air line 27, which is connected to the upper end of pneumatic cylinders 28 so as to cause retraction of piston rods 32 when air pressure is applied therethrough.

Slip assembly 15 is generally comprised of three tapered slips designated by the numerals 60, 61 and 62, which together in the closed position, as shown in FIG. 3, are arranged for gripping a pipe such as a drill pipe or casing when the same is supported in the opening through rotary housing 14. Slips 60, 61 and 62 are generally provided with wickers or teeth on the internal surface to effect such gripping. Slip 61 has radially outwardly extending bosses 70 on each side thereof for attachment of linkage means which will be described hereinafter. Slips 60 is provided with laterally extending lugs 64 and 66 which are arranged for mating with similar lugs attached to one side of slip 61 with pin 65 passing vertically therethrough such that slip 60 is hingedly connected to slip 61. In addition, pin 65 has mounted thereon a tortion spring (not shown) which normally urges of biases slip 60 to the radially outwardly direction relative to slip 61. Slip 62 is attached to the other side of slip 61 in the same manner as the just described slip 60. Hence, when slip 61 is raised vertically upwardly, slips 60 and 62 are raised therewith and are urged radially outwardly to the open position shown in FIG. 4.

As best shown in FIGS. 1 and 2, each of the slips 60, 61 and 62 is provided with a circumferentially extending upper annular shoulder 43, circumferentially extending intermediate annular shoulder 44, and a similar lower annular shoulder 45. In the raised and retracted position of slip assembly 15 as shown in FIGS. 2 and 4, annular shoulders 43 are arranged to be received in annular recess 40 provided on the internal surface of upper section 16. Similarly, annular shoulders 44 are received in annular recess 41 in upper section 16 and annular shoulders 45 are received in annular recess 42. In this retracted position, rotary housing 14 is substantially full opening. The internal surface of upper section 16 is provided with annular shoulders designated by the numerals 95, 96 and 97, the upper surfaces of which are tapered radially downwardly and inwardly for camming engagement with similar mating surfaces on the lower surfaces respectively of annular shoulders 43, 44 and 45 on slip assembly 15. Hence, upon downward movement of slip assembly 15, slips 60, 61 and 62 are cammed radially inwardly to the closed positions shown in FIGS. 1 and 2.

Referring now more particularly FIGS. 2, 3, 4, 10 and 11, linkage means for extending and retracting slip assembly 15 by pneumatic cylinders 28 will now be described. Each of the piston rods 32 is connected by a pin 51 to an extension rod 52 which extends upwardly through a generally vertical opening 58 in upper section 16. Rod 52 is connected by pin 53 to an actuator arm 54 which is pivotally supported in upper section 16 by a horizontally extending pin 55. The other end of arm 54 is provided with a slot 56 in which is mounted a pin 57 which is received in a boss 70 attached to slip 61. FIG. 2, in solid lines, shows the raised position of slip assembly 15 and arm 54. The lowered or radially inward position of arm 54, slot 56 and pin 53 is shown in dotted lines. In other words, upon upward extension of piston rods 32, slip assembly 15 is moved generally radially inwardly to the pipe engaging position shown in FIG. 3.

Referring now more particularly to FIGS. 3 and 4 and 10 and 11, release means will now be described for disengaging and removing slip assembly 15 from rotary housing 14. Each of the pins 55, after passing through an arm 54, is arranged to engage in a pin opening provided in a boss 111 attached to the internal surface of upper section 16. In addition, each pin 55 is provided with enlarged portion forming a shoulder 93 which bears against the side of an arm 54. Each pin 55 is attached to a pin extension 71 which has a counter bore on the opposite end thereof which is arranged to receive a thrust spring 72 which is held in position by a cover plate 73. Spring 72 urges pin 55 axially to the engaged position. In addition, pin extension 71 has attached therewith a laterally extending retractor arm 76 to which is attached a pin 53 which pin has heretofore been described as being connected to one end of an arm 54. A torsion spring 75 is mounted on pin 55 between shoulder 93 and arm 76 and is arranged to normally bias extractor arm 76 in an upward direction to facilitate removal and installation of slip assembly 15, as will be described hereinafter.

In addition, pin extension 71 has attached therewith a lug 80 having a pin 81 passing therethrough and through a lever arm 82 which extends upwardly therefrom. Lever 82 is arranged for pivotal movement along slot 83 and about pin 84 secured in upper section 16. Hence, upon movement of the upper end of lever 82 to the right, as shown in FIG. 10, pin extension 71 is moved to the left thereby compressing spring 72 and retracting pins 55 and 53 from engagement with arm 54. Hence, by operation of both levers 82, as shown on FIGS. 3 and 4, both arms 54 may be disengaged from extension rods 52 and slip assembly 15 together with arms 54 and may be readily lifted out of rotary housing 14. So removed, arms 76 are biased to the downward position to facilitate subsequent makeup of the slip assembly in rotary housing 14.

With slip assembly 15 removed as aforesaid, upper section 16 is then prepared to receive a bushing insert comprised of two sections designated by the numerals 100 and 101, each of which has a tapered internal surface 99 of conventional API size and configuration. With bushing inserts 100 and 101 so mounted, upper section 16 and, hence, rotary housing 14, is then converted into a conventional master bushing without completely removing housing 14. So reconstructed, rotary housing 14 can then be used to accomplish other drilling operations as is well known to those skilled in the art.

Figure 9:
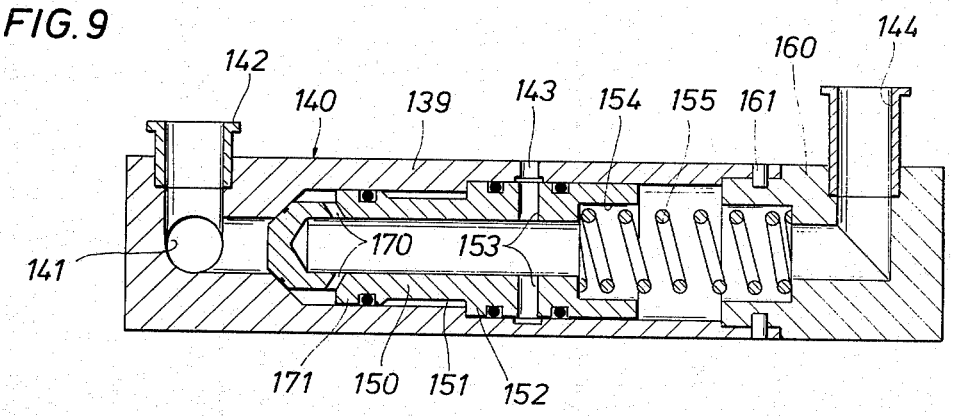
FIG. 9 is a central sectional view of one of the valves shown in FIG. 8.

Referring now more particularly to FIGS. 1, 8 and 9, the means providing pressurized air to pneumatic cylinders 28 will be described in greater detail. Each of the check valves 140 is comprised of a valve cylinder 139, the right end of which, as shown in FIG. 9, is closed by cylinder end 160 and held thereto by clip ring 161. Cylinder 139 has mounted therein and arranged for axial movement therein a valve piston 150 which is normally biased to the left by spring 155. The left end of piston 150 is closed and is provided with a seal which is arranged to abut with and close off the left end of the bore through cylinder 139, as shown in FIG. 9. Piston 150 is provided with an annular shoulder 171 which is sealed with the internal surface of the bore end cylinder 139. To the left of shoulder 171 there is provided a plurality of radially extending ports 170 which communicate from the exterior of piston 150 to the interior bore provided therein. Hence, upon unseating or moving of piston 150 to the right, fluid pressure passes inwardly through ports 170.

Check valves 140 are each provided with an air inlet port 141 which is arranged to communicate either with previously described ports **141*a* or 141*b*. In addition, each of the check valves 140 is provided with a diaphragm seal port 142 which is arranged to communicate with the radially outward side of one of the diaphragm seals 86 or 88. In addition, each of the check valves 140 is provided with a port 144 which is arranged to communicate fluid pressure through one of the diaphragm seals 86 and 88, as best shown in FIG. 8. Check valves 140 each have an additional intermediate port 143 which is arranged to communicate with ports 153 when sleeve 160 is appropriately axially aligned as shown in FIG. 9.**

In operation, pressurized air pressure is normally applied either through port **141*a* or port 141*b* to an air inlet port 141 of a check valve 140. Air pressure then is applied through port 142 to thereby cause the adjacent diaphragm seal 86 or 88 to be inflated. As this inflation increases, diaphragm seal 86 or 88, as the case may be, expands radially inwardly to thereby form an annular air duct respectively with annular recess 22 or 23. Such expansion is carried out with rotary housing 14 in the static condition. It is normally desirable to inflate seals 86 and 88 to approximately 30 to 40 PSI to effect a seal with the adjacent recess 22 or 23. As pneumatic pressure is increased above the preselected pressure exerted by spring 155, sleeve 150 is caused to move to the right such that air pressure is then applied through ports 170 and thence through port 144, which is arranged to communicate with either conduit 24 or 25 as the case may be. Continued application of air pressure to air conduit 24 causes the application of air pressure to the lower ends of pneumatic cylinders 28 causing upward extension of piston rods 32 which causes slip assembly 15** to be moved to the radially inwardly extended position.

When it becomes desirable to retract slip assembly 15, air pressure is terminated on air conduit 24 and applied to air conduit 25 in a manner previously described, which thereby applies air pressure to the upper ends of pneumatic cylinders 28, to thereby retract piston rods 32, and causing slip assembly 15 to be raised and retracted to the disengaging position. When fluid pressure is terminated at inlet port 141, spring 155 causes piston 150 to move to the left, as shown in FIG. 9, thereby aligning ports 153 with port 143, which thereby permits exhaustion of pressure from pneumatic cylinders 28, as well as from inflated seals 86 and 88.

Figure 5:
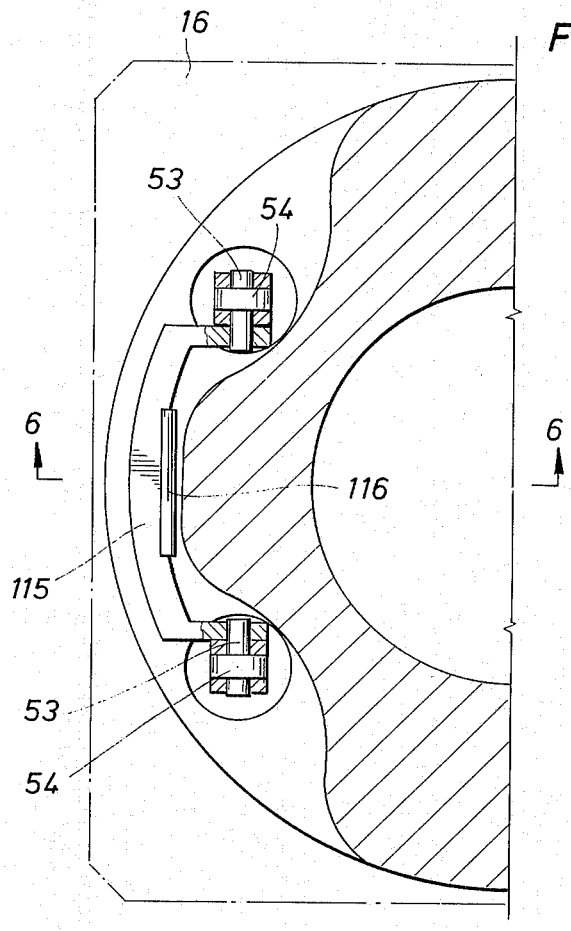
FIG. 5 is a sectional view taken generally along line 5—5 of FIG. 2.
Figure 6:
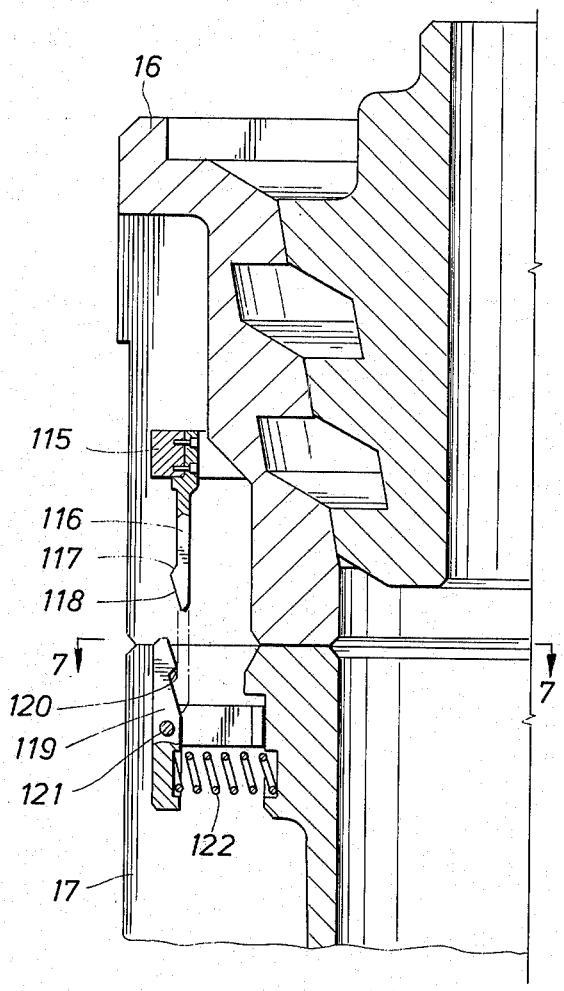
FIG. 6 is a sectional view taken generally along line 6—6 of FIG. 5.
Figure 7:
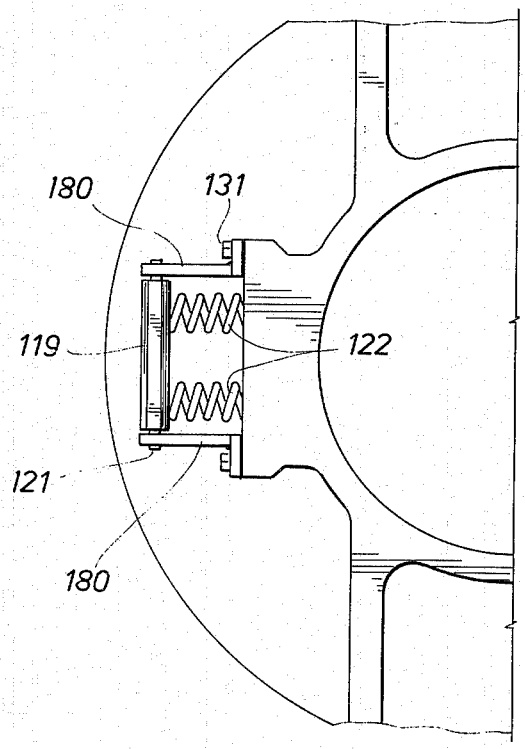
FIG. 7 is a sectional view taken generally along line 7—7 of FIG. 6.

It is desirable at certain times for the slip assembly 15 to be held in the radially retracted position when air pressure is not being applied through check valves 140. Hence, there is provided retainer means for normally retaining the slip assembly 15 in the radially retracted position. Referring now to FIGS. 5–7, one form of such retainer means will be described.

The upper ends of rods 52 are interconnected by a generally horizontally extending yoke 115 which has extending downwardly therefrom a spear 116 which has an upwardly facing shoulder 117 near lower end 118. As spear 116 is lowered, it is arranged to engage shoulder 120 of spear retainer 119 which is pivotally mounted by pin 121 on brackets 180, which in turn are attached by bolts 131 to the side of lower section 17, as shown in FIGS. 6 and 7. The lower end of spear retainer 119 is biased radially outwardly by a pair of springs 122.

In operation, as slip assembly 15 is raised and radially retracted, yoke 115 is moved downwardly such that end 118 engages spear retainer 119 and shoulder 117 engages shoulder 120 and is held by the pressure exerted by springs 122. The compression exerted by springs 122 is selected such that shoulders 117 and 120 will normally be engaged until such time as it is desirable to engage slip assembly 15 and such frictional engagement is then overcome by the pressure applied by pneumatic cylinders 28 as yoke 115 moves upwardly during such operations.

In certain situations, it is desirable to install or remove rotary housing 14 from rotary table 11 while pipe is suspended therein, and such means are shown in FIGS. 3 and 4. Rotary housing 14, including upper section 16 and lower section 17, is provided with a removable vertically extending gate 47 which has a plurality of lugs 48 on each side thereof which match with mating lugs in housing 14 and are arranged to be retained therein by vertically extending pins 46 on each side thereof. Hence, there is provided inner faces 68 and 69 on each side of gate 47, which inner faces may conveniently be sealed by a sheet of elastomeric seal material, for example, in the area of annular recesses 22 and 23 so as to hold air pressure when diaphragm seals 86 and 88 are inflated and air pressure is being applied through air conduits 24 and 25. Hence, if it becomes desirable to install rotary housing 14 while pipe is being suspended in the well bore, then gate 47 can be removed and rotary housing 14 passed around the pipe, after which gate 47 is inserted and the whole assembly then lowered into the rotary housing. By reverse operation, rotary housing 14 may be removed from the rotary table while a pipe is being supported in the rotary table.

The rotary power slip assembly of this invention can be used for making up and spinning out drill pipe and tubing and for making up casing. Such operations are effected by moving slip assembly 15 to the pipe engaging position, as heretofore described, and thereafter causing rotation of rotary housing 14 by rotation of rotary table 11 in the desired direction to accomplish either makeup or spinning out. In addition, air pressure may be appropriately applied through air ports **141*a* and 141*b* by means of an appropriate sequence valve located at the driller's console. Such sequence valve is used to insure that rotary table 11** is disengaged before air is applied to the apparatus of this invention.

In operation then, assuming it is desirable first to effect radially inward movement of slip assembly 15, air pressure is applied to one of the check valves 140 to cause diaphragm seal 86 to expand into sealing contact with annular recess 22, after which air pressure is then applied through a port 144 to air conduit 24 to the lower ends of pneumatic cylinders 28. During such operation, air pressure is relieved on diaphragm seal 88. When it became desirable to retract slip assembly 15, air pressure is relieved on diaphragm seal 86 and applied to diaphragm seal 88 until a seal is effected with recess 23 at which point pressure is then applied through air conduit 25 to the upper ends of pneumatic cylinders 28 as heretofore described.

In certain offshore operations, a drill pipe may be supported in a floating drilling platform which moves to some extend with wave action. As a consequence, quite often the pipe suspended in the well bore may be supported against one side of the well bore. In such instances, it is desirable to rotate slip assembly 15 initially to that side of the pipe which is contacting the well bore so as to urge the same to the radially inward and concentric or coaxially position with the well bore. With the apparatus of this invention, slip assembly 15 can be conveniently located on such side of the pipe by maintaining slip assembly initially in the radially retracted position and rotating rotary table 11 in conventional manner. When the slip assembly then is correctly positioned with respect to the pipe, air pressure can be appropriately applied to pneumatic cylinders 28 as heretofore described to cause slip assembly 15 to move to the radially inwardly pipe engaging position, thereby engaging and centering the drill pipe.

Further modifications and alternative embodiments of the apparatus and method of this invention will be apparent to those skilled in the art in view of this description. Accordingly, this description is to be construed as illustrative only and is for the purpose of teaching those skilled in the art the manner of carrying out the invention. It is to be understood that the forms of the invention herewith shown and described are to be taken as the presently preferred embodiment. Various changes may be made in the shape, size and arrangement of parts. For example, equivalent elements or materials may be substituted for those illustrated and described herein, parts may be reversed, and certain features of the invention may be utilized independently of the use of other features, all as would be apparent to one skilled in the art after having the benefit of this description of the invention.

What is claimed is:

1. A rotary power slip assembly mountable with a rotary drilling table, the combination comprising:

a stationary housing having an annular opening therethrough adapted for mounting generally coaxially with the pipe opening in said rotary table, said stationary housing having first conduit means for transmitting pressurized fluid;

a rotary housing having an annular opening therethrough and adapted for mounting generally coaxially with said opening in said rotary table and for rotation therewith;

means mounted in said stationary housing and cooperative with said rotary housing for forming at least one annular fluid duct therewith, with said duct being arranged for communication with said first conduit means, with said means for forming said annular duct including inflatable seal means for forming said duct when inflated and when said rotary housing is in a static condition;

at least one generally radially extendable and retractable slip mounted in said rotary housing for rotation therewith, said slip being arranged to engage a pipe inserted in said annular pipe opening in said rotary housing in the radially inwardly extended position and for releasing said pipe in the radially outwardly retracted position;

fluid actuated operator means connected to said rotary housing for rotation therewith and for moving said slip to at least one of said radial positions upon actuation thereof;

second conduit means interconnecting said annular fluid duct and said operator means for applying fluid pressure from said first conduit means to operate said operator means;

and valve means for controlling flow of fluid through said first conduit means, said annular duct, and said second conduit means to thereby operate said operator means and move said slip as aforesaid.

2. The invention as claimed in claim 1 wherein:

said rotary housing is comprised of at least two vertically separable and generally mating portions, with one of said portions having a gap extending a circumferential distance at least sufficient to permit a pipe to be passed therethrough when said portions are separated;

and seal means provided between said separable portions in the assembled condition for sealing therebetween in the areas of said duct, whereby said duct is continuous around said portions.

3. The invention as claimed in claim 1 wherein:

said operator means includes at least one pneumatic piston and cylinder assembly;

and including linkage means for interconnecting the piston rod of said piston and cylinder assembly and said slip.

4. The invention as claimed in claim 3 wherein:

said fluid conduit is arranged to communicate with one end of said pneumatic cylinder;

and said stationary housing has mounted therein means cooperative with said rotary housing for forming another annular fluid duct therebetween;

another conduit means in said rotary housing for communicating between said other duct and the other end of said pneumatic cylinder;

and said valve means includes means for selectively controlling flow of pressurized fluid through said ducts to said pneumatic cylinder to alternatively extend and retract the piston rod of said pneumatic cylinder to thereby extend and retract said slip.

5. The invention as claimed in claim 1 including:

another slip attached to each side of said first slip;

and means for exerting a biasing force urging each of said additional slips to expand radially outwardly relative to said first slip.

6. The invention as claimed in claim 1 wherein:

said slip has at least one circumferentially extending shoulder on the radially outward side thereof;

and said annular opening through said rotary housing is provided with a circumferentially extending recess adapted to receive said shoulder of said slip in the retracted position of said slip;

and said rotary housing has a circumferential cam shoulder extending radially downwardly and inwardly axially adjacent said receiving recess;

whereby when said slip is moved downwardly, said slip is also cammed radially inwardly to said pipe engaging position.

7. The invention as claimed in claim 1 wherein:

said rotary housing is removably received in said rotary table.

8. The invention as claimed in claim 6 wherein:

said stationary housing is removably supported generally adjacent one axial end of said rotary housing.

9. The invention as claimed in claim 1 including:

means for removably connecting said slip with said operator means, whereby said slip may be removed from said rotary housing while said rotary housing remains mounted in said rotary table.

10. The invention as claimed in claim 9 including:

a bushing insert adapted for mounting in said rotary housing when said slip is removed therefrom, with said inserts having standard API internal dimensions, whereby said rotary housing is thereby converted to a conventional API master bushing.

11. The invention as claimed in claim 1 including:

latch means for retaining said slip in the radially retracted position until said operator means is actuated to move said slip to the radially extended position.

12. The invention as claimed in claim 1 wherein:

said valve means includes a valve having means for applying pressurized fluid first to said inflatable seal means and then to said operator means.

13. A power slip assembly mountable with a rotary drilling table, the combination comprising:

a stationary housing having an annular opening therethrough adapted for mounting generally coaxially with the pipe opening in said rotary table, said stationary housing having first conduit means for transmitting pressurized fluid;

a rotatable housing having an annular opening therethrough and adapted for mounting generally coaxially with said opening in said rotary table and for rotation therewith, said rotary housing being comprised of at least two vertically separable and generally mating portions, with one of said portions having a gap extending a circumferential distance at least sufficient to permit a pipe to be passed therethrough when said portions are separated;

means mounted in said stationary housing and cooperative with said rotatable housing for forming at least one annular fluid duct therewith, with said duct being arranged for communication with said first conduit means;

and seal means provided between said separable portions in the assembled condition for sealing therebetween in the areas of said duct, whereby said duct is continuous around said portions;

at least one generally radially extendable and retractable slip mounted in said rotatable housing for rotation therewith, said slip being arranged to engage a pipe inserted in said annular pipe opening in said rotatable housing in the radially inwardly extended position and for releasing said pipe in the radially outwardly retracted position;

fluid actuated operator means mounted in said rotatable housing for rotation therewith and for moving said slip to at least one of said radial positions upon actuation thereof;

second conduit means interconnecting said annular fluid duct and said operator means for applying fluid pressure from said first conduit means to operate said operator means;

and valve means for controlling flow of fluid through said first conduit means, said annular duct, and said second conduit means to thereby operate said operator means and move said slip as aforesaid.

* * * * *

UNITED STATES PATENT AND TRADEMARK OFFICE

CERTIFICATE OF CORRECTION

PATENT NO. : 3,999,260

DATED : December 28, 1976

INVENTOR(S) : Terry E. Stuckey and Edward J. McFadden

It is certified that error appears in the above-identified patent and that said Letters Patent are hereby corrected as shown below:

Column 3, line 66, delete "." after the word "ring"

Column 4, line 47, "of" should be "or"

Column 8, line 23, "extend" should be "extent"

Signed and Sealed this

Fifth Day of April 1977

[SEAL]

*Attest:*

RUTH C. MASON
*Attesting Officer*

C. MARSHALL DANN
*Commissioner of Patents and Trademarks*